US008076850B2

(12) United States Patent
Shibukawa et al.

(10) Patent No.: US 8,076,850 B2
(45) Date of Patent: Dec. 13, 2011

(54) LIGHT EMITTING TUBE ARRAY, DISPLAY DEVICE EMPLOYING THE LIGHT EMITTING TUBE ARRAY, AND METHOD OF PRODUCING THE LIGHT EMITTING TUBE ARRAY

(75) Inventors: Yoshio Shibukawa, Hyogo (JP); Koji Shinohe, Hyogo (JP); Hitoshi Hirakawa, Hyogo (JP); Kenji Awamoto, Hyogo (JP)

(73) Assignee: Shinoda Plasma Corporation, Hyogo (JP)

( * ) Notice: Subject to any disclaimer, the term of this patent is extended or adjusted under 35 U.S.C. 154(b) by 411 days.

(21) Appl. No.: 12/327,036

(22) Filed: Dec. 3, 2008

(65) Prior Publication Data

US 2009/0310343 A1 Dec. 17, 2009

(30) Foreign Application Priority Data

Jun. 17, 2008 (JP) ..... 2008-158047

(51) Int. Cl.
*H01J 17/49* (2006.01)

(52) U.S. Cl. ..... 313/582; 313/634

(58) Field of Classification Search ..... 313/581–587, 313/634–636

See application file for complete search history.

(56) References Cited

U.S. PATENT DOCUMENTS

| | | | | |
|---|---|---|---|---|
| 2006/0220993 | A1 * | 10/2006 | Hirakawa et al. | 345/60 |
| 2008/0067936 | A1 | 3/2008 | Ishimoto et al. | |
| 2009/0134808 | A1 * | 5/2009 | Shinohe et al. | 315/169.1 |

FOREIGN PATENT DOCUMENTS

| | | | |
|---|---|---|---|
| JP | 2000315460 | | 11/2000 |
| JP | 200386142 | | 3/2003 |
| JP | 2003297249 | | 10/2003 |
| WO | WO 2006134660 | A1 * | 12/2006 |

* cited by examiner

*Primary Examiner* — Anne Hines

(74) *Attorney, Agent, or Firm* — Stites & Harbison PLLC; Richard S. Myers, Jr.

(57) ABSTRACT

A light emitting tube array is provided which includes: front and rear plates; and a plurality of elongated light emitting tubes each filled with a discharge gas and disposed parallel to each other between the front and rear plates, the front plate being transparent and having an enough rigidity to support the light emitting tubes, the front plate including at least one pair of display electrodes provided thereon in contact with the light emitting tubes as extending perpendicularly to the light emitting tube, the rear plate having an enough flexibility to adapt to variation in sectional dimensions of the light emitting tubes, the rear plate including address electrodes provided thereon in contact with the respective light emitting tubes as extending longitudinally of the light emitting tubes.

9 Claims, 6 Drawing Sheets

LIGHT EMITTING TUBE ARRAY, DISPLAY DEVICE EMPLOYING THE LIGHT EMITTING TUBE ARRAY, AND METHOD OF PRODUCING THE LIGHT EMITTING TUBE ARRAY

CROSS-REFERENCE TO RELATED APPLICATIONS

This application is related to Japanese patent application No. 2008-158047 filed on Jun. 17, 2008, whose priority is claimed under 35 USC §119, the disclosure of which is incorporated by reference in its entirety.

BACKGROUND OF THE INVENTION

1. Field of the Invention

The present invention relates to a light emitting tube array and a display device employing the light emitting tube array and, particularly, to a plasma tube array including a plurality of elongated plasma tubes and adapted to be driven by electrodes provided outside the plasma tubes.

2. Description of the Related Art

An elongated glass tube having a fluorescent layer provided therein and filled with a discharge gas with opposite ends thereof sealed is generally called "light emitting tube" or "plasma tube". A display panel including a multiplicity of such plasma tubes regularly arranged, a plurality of transparent display electrodes provided on a front side thereof as extending perpendicularly to the plasma tubes and data electrodes (address electrodes) provided on a back side thereof as extending parallel to the plasma tubes is generally called "plasma tube array" or "PTA". In the PTA, electric discharge is caused by applying operating voltages to the display electrodes and the data electrodes, and UV radiation generated by the electric discharge excites a fluorescent material, which in turn emits visible light for display (see, for example, JP-A-2000-315460).

The PTA is configured such that the plasma tubes are sandwiched between a front plate formed with the display electrodes and a rear plate formed with the address electrodes and combined with the front plate and the rear plate by an adhesive tape or an adhesive agent. Therefore, the PTA is a very light and flexible display device.

In principle, the display size of the PTA is determined by the length and number of the plasma tubes. Therefore, the PTA is more advantageous than existing display devices (PDPs and LCDs) to provide a large-scale display panel.

A known technique for improving the brightness of the PTA is to increase contact areas between the plasma tubes and the display electrodes provided on the front plate (see, for example, JP-A-2003-86142).

Further, a known technique for stabilizing the driving voltages is to use a flexible sheet such as a resin film as the front plate and to reduce the influence of variations in the sectional shapes of the plasma tubes (see, for example, JP-A-2003-297249).

While the display size of the PTA is determined by the number of the plasma tubes (light emitting tubes) as described above, the PTA (light emitting tube array), which generally includes several thousands of plasma tubes, suffers from variations in the sectional shapes and the sectional sizes of the plasma tubes.

In the PTA (disclosed in JP-A-2000-315460) which includes the plasma tubes T sandwiched between the front plate Ff provided with the display electrodes Ed and the rear plate Fr provided with the address electrodes Ea as shown in FIG. 8, a thin flexible sheet is used as the front plate Ff to accommodate the variations in the sectional shapes of the plasma tubes T so that the display electrodes Ed are kept in intimate contact with the light emitting tubes T.

Even with such a construction, the PTA suffers from uneven display (uneven brightness), because the contact areas between the display electrodes Ed and the plasma tubes T differ depending on the sizes of the plasma tubes T as shown in FIG. 8.

SUMMARY OF THE INVENTION

In view of the foregoing, it is an object of the present invention to provide a PTA which is free from uneven display even if having variations in the sizes of the plasma tubes.

The present invention provides a light emitting tube array, which includes: front and rear plates; and a plurality of elongated light emitting tubes each filled with a discharge gas and disposed parallel to each other between the front and rear plates, the front plate being transparent and having a first material quality and a first thickness, the first material quality and the first thickness having an enough rigidity to support the light emitting tubes, the front plate including at least one pair of display electrodes provided thereon in contact with the light emitting tubes as extending perpendicularly to the light emitting tube, the rear plate having a second material quality, a second thickness and a shape, the second material quality, the second thickness and the shape having an enough flexibility to adapt to variation in sectional dimensions of the light emitting tubes, the rear plate including address electrodes provided thereon in contact with the respective light emitting tubes as extending longitudinally of the light emitting tubes.

According to the present invention, the first material quality and the first thickness of the front plate are enough to support the light emitting tubes, and the second material quality, the second thickness and the shape of the rear plate are enough to accommodate the variations in the sectional dimensions of the light emitting tubes. Therefore, even if the light emitting tubes disposed between the front plate and the rear plate have variations in the sectional dimensions and the sectional shapes thereof, the front plate maintains its flat shape, and the display electrodes as well as the front plate are kept in intimate contact with the light emitting tubes. Further, the rear plate is flexed to accommodate the variations in the sectional dimensions of the light emitting tubes, and the address electrodes as well as the rear plate are kept in intimate contact with the light emitting tubes.

Thus, the contact areas between the light emitting tubes and the display electrodes provided on the front plate are constant, so that the light emitting tube array is free from uneven display (uneven brightness).

DETAILED DESCRIPTION OF THE INVENTION

Figure 1:
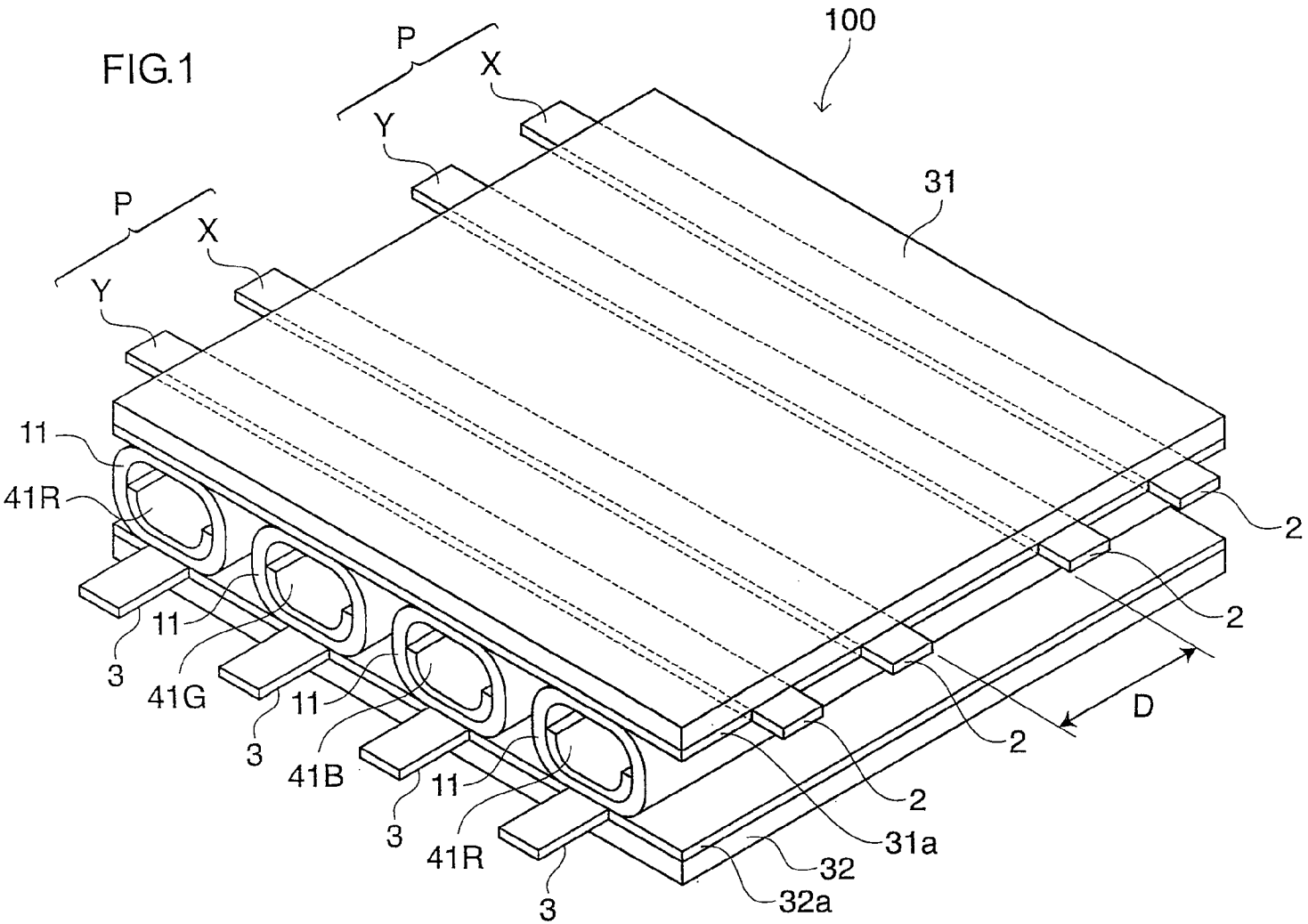
FIG. 1 is a perspective view illustrating a PTA according to an embodiment of the present invention.

The inventive light emitting tube array (PTA) includes a transparent front plate having a first material quality and a first thickness, a rear plate having a second material quality, a second thickness and a predetermined shape, and a plurality of elongated light emitting tubes disposed parallel to each other between the front plate and the rear plate and each filled with a discharge gas. The first material quality and the first thickness of the front plate are effective to support the light emitting tubes. The second material quality, the second thickness and the predetermined shape of the rear plate are effective to accommodate variations in the sectional dimensions of the light emitting tubes. The PTA further includes at least one pair of display electrodes provided on the front plate in contact with the light emitting tubes as extending perpendicularly to the light emitting tubes, and address electrodes provided on the rear plate in contact with the respective light emitting tubes as extending longitudinally of the light emitting tubes.

In the present invention, it is preferred that the front and rear plates are respectively made of resin films having the same material quality, and the rear plate has a smaller thickness than the front plate.

In general, the flexural rigidity of a plate is represented by $Et^3/\{12(1-\nu^2)\}$ (wherein t is the thickness of the plate, E is Young's modulus, and $\nu$ is Poisson ratio) and, therefore, is proportional to the cube of the plate thickness t. This means that the rear plate having a smaller thickness than the front plate has smaller flexural rigidity and, hence, higher flexibility and higher extensibility.

The flexibility generally means the property of being easily flexed, twisted and compressed when an external force is applied to the plate.

The extensibility generally means the property of being able to be stretched when an external force is applied to the plate, and particularly means an elongation percentage which is defined as the percentage of elongation based on an original length as observed when a given load is applied to the plate. The flexibility and the extensibility are herein related to the degree of deformation of the plate occurring according to the sectional dimensions and the sectional shapes of the light emitting tubes when an external pressure is applied to the plate.

In the present invention, the rear plate may have a slit or a grooved region provided parallel to the light emitting tubes between each two adjacent light emitting tubes or between each two adjacent light emitting tube groups each including a plurality of consecutively arranged light emitting tubes. The slit of the rear plate may be a single continuous elongated slit extending parallel to the light emitting tubes or a slit including a plurality of discontinuous elongated slit portions parallel to the light emitting tubes. Where the slit is the single continuous elongated slit, the rear plate is divided into individual plate portions by the slit.

The grooved region of the rear plate may be a region including a V-shaped groove or a U-shaped groove, or a region including a portion having a smaller thickness than the other portion of the rear plate.

In the presence of the slit or the grooved region, the rear plate is divided or flexed by a pressure to accommodate the variations in the sectional dimensions or the sectional shapes of the light emitting tubes. Thus, the address electrodes as well as the rear plate are kept in intimate contact with the light emitting tubes.

In the present invention, the light emitting tubes preferably each have a flat portion having a predetermined width and extending longitudinally thereof in contact with the front plate and the display electrodes. The present invention also provides a display device including the aforementioned light emitting tube array.

Any of various plates known in the art may be used as the front plate and the rear plate. For example, resin films may be used as the front plate and the rear plate. Examples of the resin films include commercially available polycarbonate films and polyethylene terephthalate (PET) films.

The inventive PTA serves as a display panel for displaying a given image, and the elongated light emitting tubes to be arranged parallel to each other in the PTA each have a diameter of, for example, about 0.5 to about 5 mm. However, the sizes of the light emitting tubes are not particularly limited. The light emitting tubes may each be an elongated display tube which includes a fluorescent layer provided therein and a discharge gas filled therein and has a longitudinally extending flat portion having a flat oval cross section or a rectangular cross section. The present invention is particularly effective for a PTA which includes light emitting tubes each having a rectangular cross section having variations in minor edge length rather than major edge length. A material for the light emitting tubes is not particularly limited.

The display electrodes and the address electrodes may be disposed on surfaces of the front plate and the rear plate, respectively, opposed to the light emitting tubes. The display electrodes and the address electrodes are preferably capable of applying a voltage to the light emitting tubes from the outside to cause electric discharge in the light emitting tubes. These electrodes may be formed on the aforementioned films by a printing method, a deposition method or other known method. These electrodes may be made of any of various electrode materials known in the art. Examples of the electrode materials include Cu, Cr, Al, Au and Ag.

The front and rear plates may be bonded to the light emitting tubes via adhesive layers. The adhesive layers may be provided on the surfaces of the front plate and the rear plate, respectively, opposed to the light emitting tubes. Any of various adhesive materials known in the art may be used for the adhesive layers. For example, the adhesive layers may be formed of a resin adhesive. The thicknesses of the adhesive layers are not particularly limited. The adhesive layers are desirably made of a transparent adhesive.

The adhesive layers may be made of a thermoplastic adhesive, a thermosetting adhesive, a pressure sensitive adhesive or a UV-curable adhesive. Specific examples of the transparent adhesive include an UV-curable adhesive EXP-90 (available from Sumitomo 3M Ltd.) and highly transparent adhesive transfer tapes (adhesive sheets) #8141, #8142 and #8161, which each have a light transmittance not lower than 75%.

With reference to the attached drawings, the present invention will hereinafter be described in detail by way of an embodiment thereof.

FIG. 1 is a perspective view illustrating a PTA 100 according to one embodiment of the present invention.

In FIG. 1, the PTA 100 includes a plurality of plasma tubes 11 arranged parallel to each other, a transparent front plate 31, a transparent or opaque rear plate 32, a plurality of display electrode pairs P, and a plurality of signal electrodes or address electrodes 3. In FIG. 1, the electrode pairs P each include two display electrodes 2, i.e., a sustain electrode X and a scanning electrode Y.

Red (R), green (G) and blue (B) fluorescent layers 41R, 41G, 41B are respectively formed on rear interior surface portions of the plasma tubes 11. A discharge gas is filled in the plasma tubes 11, and opposite ends of each of the plasma tubes 11 are sealed.

The address electrodes 3 are provided on a front surface or an inner surface of the rear plate 32 as extending longitudinally of the plasma tubes 11. The address electrodes 3 are arranged at the same pitch as the plasma tubes 11, and the pitch is typically 1 to 1.5 mm. The plurality of display electrode pairs P are provided on a rear surface or an inner surface of the front plate 31 as extending perpendicularly to the address electrodes 3. The electrodes X, Y each have a width of 0.75 mm, for example. The electrodes X, Y of each of the display electrode pairs P are spaced, for example, a distance of 0.4 mm from each other. An elongated non-display region or a non-discharge gap, for example, having a width D of 1.1 mm is provided between each two adjacent display electrode pairs P.

When the PTA 100 is assembled, the address electrodes 3 are bonded to lower outer peripheral surface portions of the respective plasma tubes 11, and the display electrodes 2 are bonded to upper outer peripheral surface portions of the plasma tubes 11. As shown in FIG. 1, adhesive layers 31*a* and 32*a* are respectively provided between the front plate 31 and the plasma tubes 11 and between the rear plate 32 and the plasma tubes 11.

Intersections between the address electrodes 3 and the display electrode pairs P as seen in plan from the front side of the PTA 100 are each defined as a unit light emitting point. For display, a light emitting region is selected by establishing a selection discharge at an intersection between a scanning electrode Y and an address electrode 3, and a display discharge is established by the display electrode pair P by utilizing wall charges generated in the light emitting region on the interior surface of the tube to cause a fluorescent layer to emit light. The selection discharge is an opposed discharge established in the plasma tube 11 between the scanning electrode Y and the address electrode 3. The display discharge is a surface discharge established in the plasma tube 11 between a sustain electrode X and the scanning electrode Y disposed parallel to each other in a plane.

That is, the PTA 100 is configured such that the fluorescent layers 41R, 41G, 41B are caused to emit light by the electric discharge of the display electrode pairs P provided in surface contact with flat portions of the plasma tubes 11 to provide a multiplicity of light emitting points in each of the plasma tubes 11. The plasma tubes 11 each have a sectional size having a major axis length of not greater than 2 mm and a minor axis length of not greater than 1 mm, and a thickness of about 100 μm and a length of not less than 300 mm.

The plasma tubes 11 are made of borosilicate glass. As shown in FIG. 1, the plasma tubes 11 each have a generally rectangular cross section having flat portions on its display side and rear side. These flat portions are located parallel to the front plate 31.

The fluorescent layers 41R, 41G, 41B are each formed by applying a fluorescent paste and firing the resulting fluorescent paste layer. Usable as the fluorescent paste are any of various fluorescent pastes known in the art.

An electron emission film may be provided on an interior surface of each of the plasma tubes 11. The electron emission film generates charged particles when being bombarded with atoms of the discharge gas having an energy level not lower than a certain level. When a voltage is applied to the display electrode pairs P, the atoms of the discharge gas filled in the plasma tubes 11 are excited, and ultraviolet radiation generated during deexcitation of the gas atoms causes the fluorescent layers 41R, 41G, 41B to emit visible light.

The front plate 31 supports the arrayed plasma tubes 11 in contact with the upper flat portions of the plasma tubes 11. In this embodiment, the front plate 31 is made of a transparent flexible and extensible PET film having a thickness of 150 μm.

The display electrodes 2 each include a transparent electrode such as of ITO and a bus electrode of a metal such as Cu or Cr. These electrodes are formed by a printing method or a low temperature sputtering method which is known in the art.

As described above, the adhesive layer 31*a* is provided in addition to the display electrodes 2 on the surface of the front plate 31 opposed to the plasma tubes 11. When the front plate 31 is brought into contact with the flat portions of the plasma tubes 11, the front plate 31 is bonded to the flat portions of the plasma tubes 11 via the adhesive layer 31*a* with the display electrodes 2 being opposed to the flat portions.

An adhesive agent or an adhesive tape may be used for the adhesive layer 31*a*. The adhesive layer 31*a* is not necessarily required to cover the entire surface of the front plate 31, but may be provided between each two adjacent display electrode pairs P (on a so-called non-discharge slit in which no electric discharge occurs between the display electrodes). Where the adhesive layer 31*a* is provided on the non-discharge slit, the non-discharge slit may be darkened by using a black (dark color) adhesive agent or adhesive tape for improvement of the contrast of the display. For this purpose, a black film separate from the adhesive agent or the adhesive tape may be additionally provided.

In this manner, the front plate 31 having the display electrodes 2 provided on its inner surface is bonded to the plasma tubes 11 by a laminating method or the like, so that the display electrodes 2 are brought into surface contact with the flat portions of the plasma tubes 11.

The rear plate 32 is made of a PET film having a thickness of 50 μm, which is smaller than the thickness of the front plate 31 (150 μm). The rear plate 32 contacts the rear flat portions of the plasma tubes 11. That is, the PTA 100 is configured such that the plasma tubes 11 arranged parallel to each other are held between the rear plate 32 and the front plate 31.

The front plate 31 should be transparent for visibility. On the other hand, the rear plate 32 is not necessarily required to be transparent, but rather preferably has a dark color for higher background contrast.

The address electrodes 3 are provided on the surface of the rear plate 31 opposed to the plasma tubes 11 as extending longitudinally of the plasma tubes 11. As described above, the address electrodes 3 each serve to cause the selection discharge between the address electrode 3 and one electrode of the display electrode pair P. Since the address electrodes 3 are provided on the rear plate 32 which may be impervious to light, the address electrodes 3 are formed of a metal alone. The formation of the address electrodes 3 is achieved by a printing method or a low temperature sputtering method which is known in the art.

After the formation of the address electrodes 3, the adhesive layer 32*a* is formed on the surface of the rear plate 32 opposed to the plasma tubes 11. The adhesive layer 32*a* may be formed of the same material as the adhesive layer 31*a* on the front plate 31.

The PTA 100 is configured such that the plasma tubes 11 are sandwiched between the front plate 31 and the rear plate 32 which are both flexible and, therefore, can be flexed parallel or perpendicularly to the plasma tubes 11.

For production of the PTA 100 shown in FIG. 1, the front plate 31 (FIG. 1) having the display electrodes 2 and the adhesive layer 31*a* formed on its surface is first placed on a horizontal surface with the adhesive layer 31*a* facing up. Then, the plurality of plasma tubes 11 are placed parallel to each other on the front plate 31. Subsequently, the rear plate 32 (FIG. 1) having the address electrodes 3 and the adhesive layer 32*a* formed on its surface is stacked on the plasma tubes 11 with the adhesive layer 32*a* facing down. In turn, the plasma tubes 11 are laminated with the front plate 31 and the rear plate 32 by means of a laminator.

For the lamination, the rear plate 32 is horizontally tensioned, and a flexible press roller is moved parallel to or perpendicularly to the plasma tubes 11 to press the resulting assembly. The press roller is moved to the endmost plasma tube 11 while being rotated.

Where a pressure-sensitive adhesive is used for the formation of the adhesive layers 31*a*, 32*a*, the front and rear plates 31, 32 can be bonded to the plasma tubes 11 simply by the pressure applied by the roller at an ordinary temperature. Where a thermoplastic adhesive is used for the formation of the adhesive layers 31*a*, 32*a*, a heat roller is used.

Figure 2:
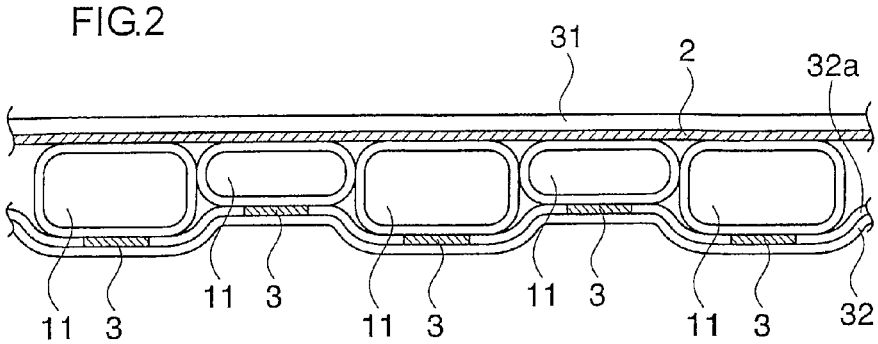
FIG. 2 is a sectional view illustrating the PTA according to the embodiment.

FIG. 2 is a sectional view of the PTA 100 produced in the aforementioned manner.

In this embodiment, as described above, the front plate 31 is formed of the 150-μm thick PET film, and the rear plate 32 is formed of the 50-μm thick PET film. That is, the rear plate 32 is more flexible and more extensible than the front plate 31.

Therefore, when the plasma tubes 11 are laminated with the front plate 31 and the rear plate 32 by means of the laminator as described above, the front plate 31 maintains its flat shape, and the rear plate 32 is deformed to accommodate variations in the sectional dimensions and the sectional shapes of the plasma tubes 11 as shown in FIG. 2. Thus, the contact areas between the display electrodes 2 and the plasma tubes 11 are constant without the influence of the variations in the sectional dimensions and the shapes of the plasma tubes 11.

First Modification

Figure 3:
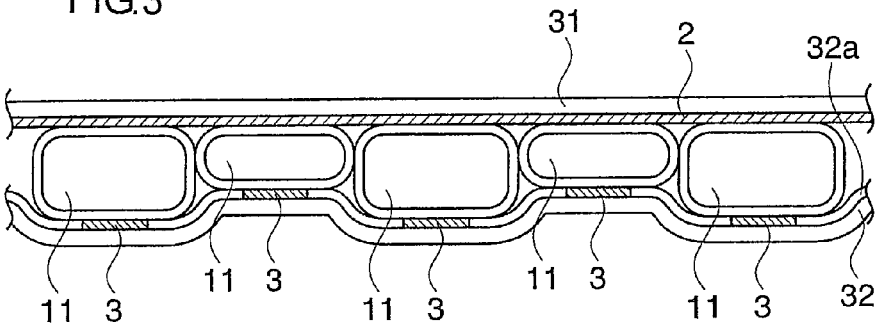
FIG. 3 is a sectional view illustrating a PTA according to a first modification of the embodiment as corresponding to FIG. 2.

FIG. 3 illustrates a first modification of the aforementioned embodiment (FIGS. 1 and 2) as corresponding to FIG. 2. This modification has substantially the same construction as the aforementioned embodiment, except that the rear plate 32 is made of a resin film having a thickness of 150 μm, which is the same as the thickness of the front plate 31, and having an elongation percentage which is five times the elongation percentage of the front plate 31. Therefore, when the plasma tubes 11 are laminated with the front plate 31 and the rear plate 32 by means of a laminator as described above, the front plate 31 maintains its flat shape, and the rear plate 32 is deformed to accommodate variations in the sectional dimensions and the sectional shapes of the plasma tubes 11 as shown in FIG. 3. Thus, the contact areas between the display electrodes 2 and the plasma tubes 11 are constant without the influence of the variations in the sectional dimensions and the sectional shapes of the plasma tubes 11.

Second Modification

Figure 4:
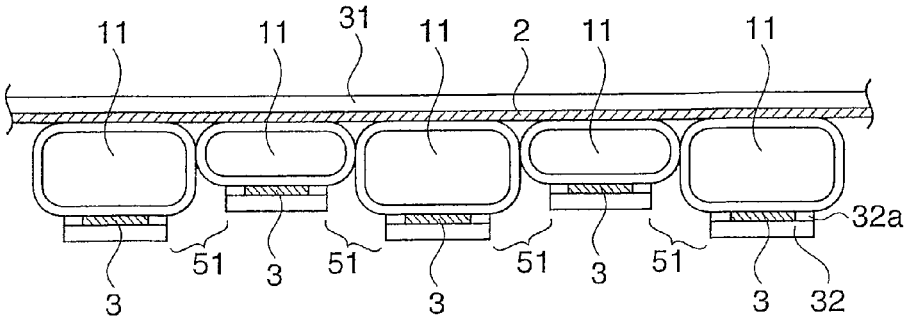
FIG. 4 is a sectional view illustrating a PTA according to a second modification of the embodiment as corresponding to FIG. 2.

FIG. 4 illustrates a second modification of the aforementioned embodiment (FIGS. 1 and 2) as corresponding to FIG. 2. In this modification, the rear plate 32 is made of a PET film having a thickness of 150 μm, which is the same as the thickness of the front plate 31. The rear plate 32 includes boundary regions 51 which are each defined between each two adjacent plasma tubes 11 as extending parallel to the plasma tubes 11 and are each formed with a continuous slit. That is, the rear plate 32 is divided into independent plate portions each associated with a single plasma tube 11. This modification has substantially the same construction as the embodiment shown in FIGS. 1 and 2 except for the aforementioned point.

Therefore, when the plasma tubes 11 are laminated with the front plate 31 and the rear plate 32, the front plate 31 maintains its flat shape, and the rear plate 32 is divided to accommodate the variations in the sectional dimensions and the sectional shapes of the plasma tubes 11 as shown in FIG. 4. Thus, the contact areas between the display electrodes 2 and the plasma tubes 11 are constant without the influence of the variations in the sectional dimensions and the sectional shapes of the plasma tubes 11.

Third Modification

Figure 5:
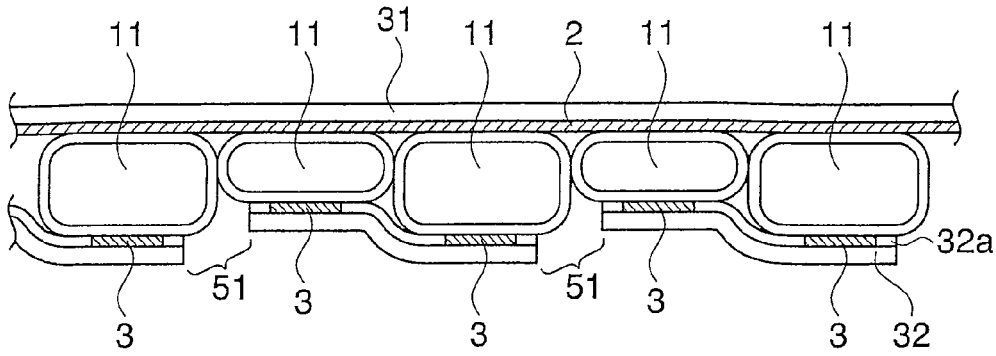
FIG. 5 is a sectional view illustrating a PTA according to a third modification of the embodiment as corresponding to FIG. 2.

FIG. 5 illustrates a third modification of the aforementioned embodiment (FIGS. 1 and 2) as corresponding to FIG. 2. In this modification, the rear plate 32 has a thickness of 150 μm, which is the same as the thickness of the front plate 31. The rear plate 32 includes boundary regions 51 which are each defined between each two adjacent plasma tube groups each including two consecutively arranged plasma tubes 11 as extending parallel to the plasma tubes 11 and are each formed with a continuous slit. That is, the rear plate 32 is divided into independent plate portions each associated with the two consecutively arranged plasma tubes 11. This modification has substantially the same construction as the embodiment shown in FIGS. 1 and 2 except for the aforementioned point.

Therefore, when the plasma tubes 11 are laminated with the front plate 31 and the rear plate 32, the front plate 31 maintains its flat shape, and the rear plate 32 is deformed to accommodate the variations in the sectional dimensions and the sectional shapes of the plasma tubes 11 as shown in FIG. 5. Thus, the contact areas between the display electrodes 2 and the plasma tubes 11 are constant without the influence of the variations in the sectional dimensions and the sectional shapes of the plasma tubes 11.

Fourth Modification

Figure 6:
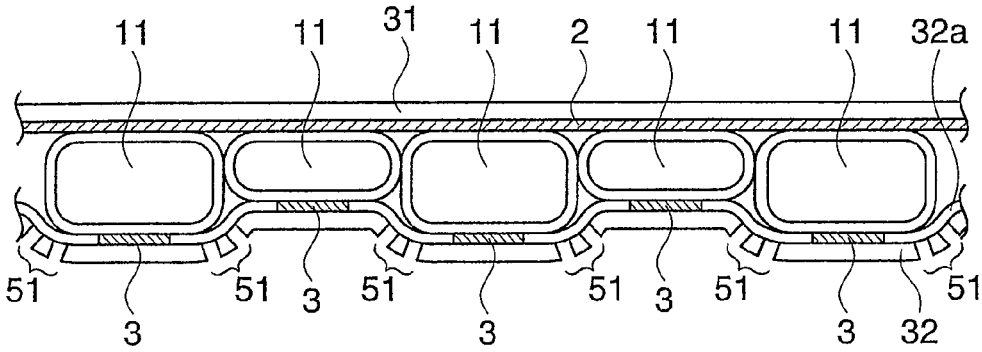
FIG. 6 is a sectional view illustrating a PTA according to a fourth modification of the embodiment as corresponding to FIG. 2.

FIG. 6 illustrates a fourth modification of the embodiment (FIGS. 1 and 2) as corresponding to FIG. 2. In this modification, the rear plate 32 has a thickness of 150 μm, which is the same as the thickness of the front plate 31. The rear plate 32 includes boundary regions 51 which are each defined between each two adjacent plasma tubes 11 as extending parallel to the plasma tubes 11 and are each formed with two parallel slits each discontinuously extending longitudinally of the plasma tubes 11. This modification has substantially the same construction as the embodiment shown in FIGS. 1 and 2 except for the aforementioned point.

Therefore, when the plasma tubes 11 are laminated with the front plate 31 and the rear plate 32, the front plate 31 maintains its flat shape, and the rear plate 32 is flexed to accommodate the variations in the sectional dimensions and the sectional shapes of the plasma tubes 11 as shown in FIG. 6. Thus, the contact areas between the display electrodes 2 and the plasma tubes 11 are constant without the influence of the variations in the sectional dimensions and the sectional shapes of the plasma tubes 11.

Fifth Modification

Figure 7:
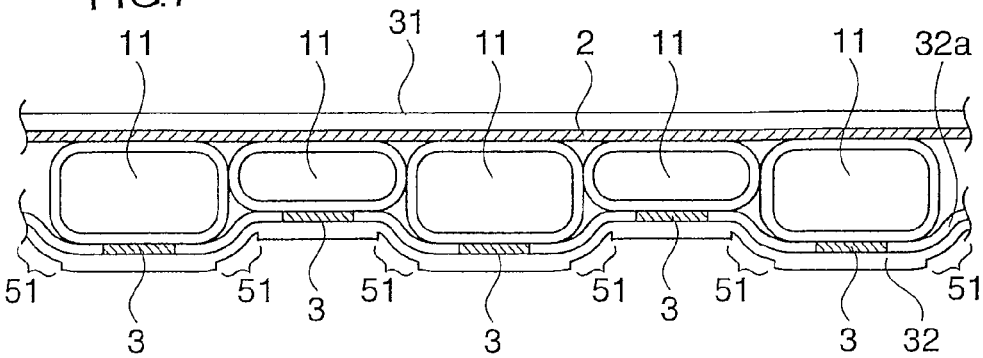
FIG. 7 is a sectional view illustrating a PTA according to a fifth modification of the embodiment as corresponding to FIG. 2.
Figure 8:
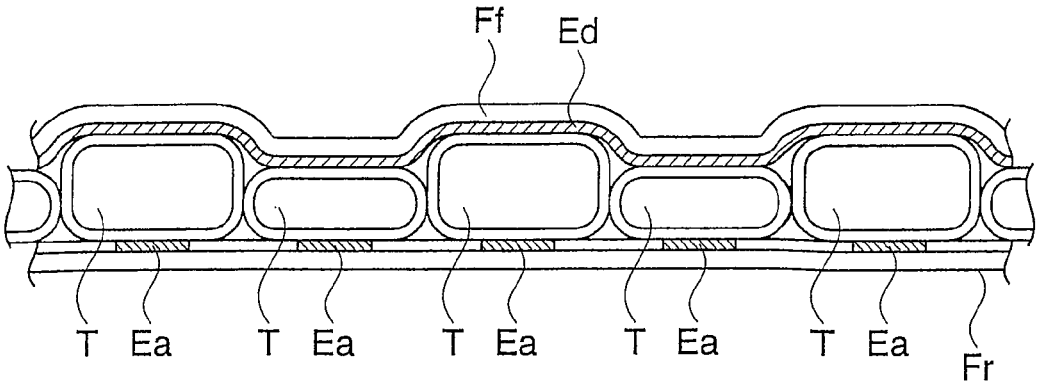
FIG.8 PRIOR ART
FIG. 8 is a sectional view of a prior-art PTA.

FIG. 7 illustrates a fifth modification of the embodiment (FIGS. 1 and 2) as corresponding to FIG. 2. In this modification, the rear plate 32 has a thickness of 150 μm, which is the same as the thickness of the front plate 31. The rear plate 32 includes boundary regions 51 which are each defined between each two adjacent plasma tubes 11 as extending parallel to the plasma tubes 11 and are each formed with a single groove having a generally rectangular cross section. That is, the boundary regions 51 of the rear plate 32 each have a thickness which is half the thickness of the other region of the rear plate 32 due to the presence of the groove. This modification has substantially the same construction as the embodiment shown in FIGS. 1 and 2 except for the aforementioned point.

Therefore, when the plasma tubes 11 are laminated with the front plate 31 and the rear plate 32, the front plate 31 maintains its flat shape, and the rear plate 32 is flexed along the boundary regions 51 to accommodate the variations in the sectional dimensions and the sectional shapes of the plasma tubes 11 as shown in FIG. 7. Thus, the contact areas between the display electrodes 2 and the plasma tubes 11 are constant without the influence of the variations in the sectional dimensions and the sectional shapes of the plasma tubes 11.

Figure 9:
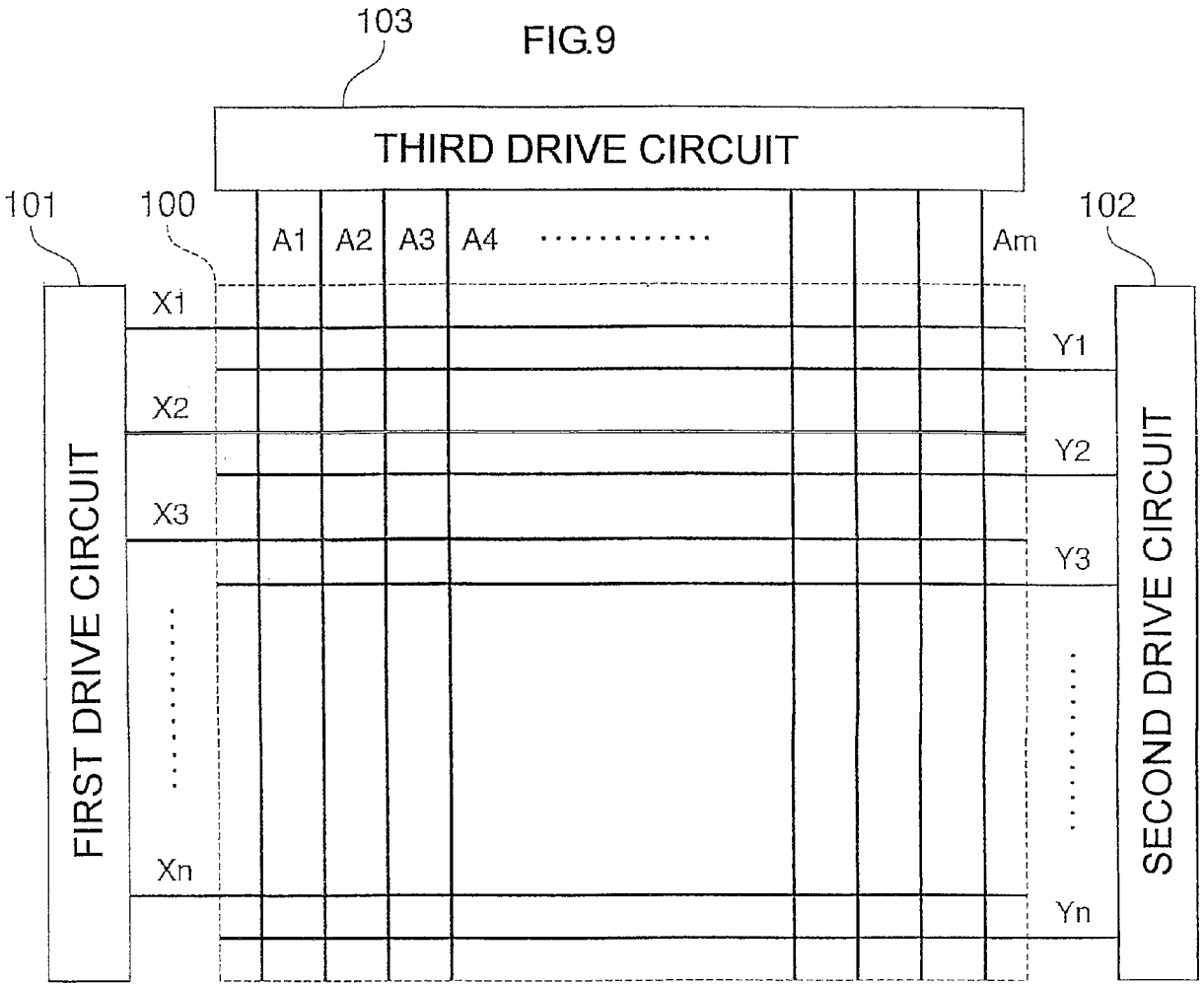
FIG. 9 is a block diagram of a display device employing the inventive PTA.

FIG. 9 is a block diagram illustrating a display device employing the PTA 100. As shown in FIG. 9, a drive voltage is applied to sustain electrodes X1 to Xn from a first drive circuit 101. A drive voltage is applied to scanning electrodes Y1 to Yn from a second drive circuit 102. An address voltage is applied to address electrodes A1 to Am from a third drive circuit 103.

Figure 10:
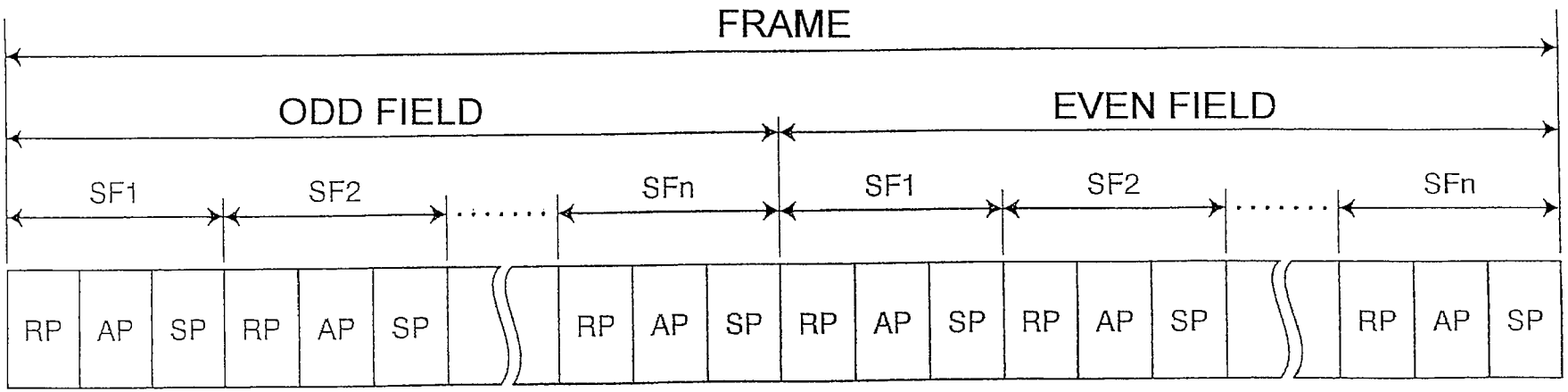
FIG. 10 is a diagram showing the configuration of a single frame of an image displayed on the display device shown in FIG. 9.

FIG. 10 shows the configuration of a single frame of a display image. The frame is divided into two fields, i.e., an odd field and an even field. The odd field and the even field each include a plurality of subfields SF1 to SFn. In the odd field, the first, second and third drive circuits 101, 102, 103 apply the voltages to the electrodes so as to perform a reset operation, an address operation and a display operation in odd display lines of the PTA 100 shown in FIG. 2 as will be described later in detail. In the even field, the first, second and third drive circuits 101, 102, 103 apply the voltages to the electrodes so as to perform the reset operation, the address operation and the display operation in even display lines of the PTA 100.

Therefore, as shown in FIG. 10, the subfields SF1 to SFn each include a reset period RP during which the reset operation is performed to uniformize charges in all display cells of the subfield screen, an address period AP during which the address operation is performed to establish an address discharge in predetermined unit light emitting regions or display cells to select the display cells and accumulate wall charges in the selected display cells, and a display (sustain) period SP during which the display operation is performed to sustain the discharge in the selected display cells by using the accumulated wall charges.

In the reset operation in the reset period RP, a reset pulse is applied between the sustain electrodes X and the scanning electrodes Y of the respective display electrode pairs P to cause electric discharge for erasing the wall charges in the respective display cells. In the address operation in the address period AP, a scan pulse is sequentially applied to the scanning electrodes Y, and an address pulse is applied to address electrodes A corresponding to display cells to be energized in synchronization with the application of the scan pulse, whereby the address discharge is established in display cells located at addresses defined by intersections between the scanning electrodes Y and the address electrodes A to generate wall charges in these display cells. In the display operation in the sustain period SP, a sustain pulse (sustain voltage) is applied to the sustain electrodes X and the scanning electrodes Y of the respective display electrode pairs P to establish a sustain discharge in the display cells or the unit light emitting regions in which the wall charges are generated.

Gradation display is achieved by changing the duration of the display period SP (the number of times of the discharge) during which the display operation is performed in each of the subframes according to display data. Where the ratio of the numbers of the times of the discharge in the eight subframes is set to 1:2:4:8:16:32:64:128, for example, each unit light emitting region has 256 gradation levels. Each pixel is defined by three unit light emitting regions, so that full color display of about 16.77 million (=256×256×256) color tones can be achieved.

The numerical values appearing in the embodiment and the modifications of the embodiment described above are merely illustrative of the best mode of the present invention, and may be changed as appropriate according to actual applications.

What is claimed is:

1. A light emitting tube array, comprising:

front and rear plates; and a plurality of elongated light emitting tubes each filled with a discharge gas and disposed parallel to each other between the front and rear plates, the front plate including at least one pair of display electrodes provided thereon in contact with an upper surface of each light emitting tube and extending across the light emitting tubes;

the rear plate including address electrodes provided thereon in contact with a lower surface of each light emitting tube and extending parallel to the light emitting tubes; wherein the rear plate has a slit or a groove provided parallel to the light emitting tubes between each two adjacent light emitting tubes or between each two adjacent light emitting tube groups, each of the light emitting tube groups including a plurality of consecutively arranged light emitting tubes.

2. A light emitting tube array as set forth in claim 1, wherein the light emitting tubes each have a flat portion having a predetermined width and extending longitudinally thereof in contact with the front plate and the display electrodes.

3. A display device including a light emitting tube array as recited in claim 2.

4. A light emitting tube array as set forth in claim 1, wherein the rear plate is divided into a plurality of independent plate portions which are each associated with at least one light emitting tube.

5. A display device including a light emitting tube array as recited in claim 4.

6. A light emitting tube array as set forth in claim 1, wherein the front plate is transparent and has a material quality and a thickness which are rigid enough to support the light emitting tubes, and wherein the rear plate has a material quality, a thickness, and a shape which are flexible enough to adapt to variations in the sectional dimensions of the light emitting tubes.

7. A light emitting tube array as set forth in claim 1, wherein the front and rear plates are respectively made of resin films having the same material quality, and the rear plate has a smaller thickness than the front plate.

8. A light emitting tube array as set forth in claim 1, wherein the front and rear plates are respectively made of resin films, and the rear plate is more flexible and more extensible than the front plate.

9. A display device including a light emitting tube array as recited in claim 1.

* * * * *